US005292385A

United States Patent [19]

Kington

[11] Patent Number: 5,292,385

[45] Date of Patent: Mar. 8, 1994

[54] TURBINE ROTOR HAVING IMPROVED RIM DURABILITY

[75] Inventor: Harry L. Kington, Scottsdale, Ariz.

[73] Assignee: AlliedSignal Inc., Morris Township, Morris County, N.J.

[21] Appl. No.: 809,663

[22] Filed: Dec. 18, 1991

[51] Int. Cl.[5] ..... F01D 5/28; C22C 19/05

[52] U.S. Cl. ..... 148/404; 148/428; 416/241 R

[58] Field of Search ..... 148/404, 410, 428; 416/241 R

[56] References Cited

U.S. PATENT DOCUMENTS

| | | | |
|---|---|---|---|
| 3,598,169 | 8/1971 | Copley et al. | 164/60 |
| 4,097,276 | 6/1978 | Six | 416/244 A |
| 4,292,010 | 9/1981 | Meetham et al. | 416/241 R |
| 4,335,997 | 6/1982 | Ewing et al. | 416/241 R |
| 4,529,452 | 7/1985 | Walker | 420/902 |
| 4,581,300 | 4/1986 | Hoppin, III et al. | 428/546 |
| 4,605,452 | 8/1986 | Gemma et al. | 148/404 |
| 4,908,183 | 3/1990 | Chin et al. | 148/404 |
| 4,921,405 | 5/1990 | Wilson | 416/241 R |
| 4,935,072 | 6/1990 | Nguyen-Dinh | 148/404 |
| 5,061,154 | 10/1991 | Kington | 416/241 R |

*Primary Examiner*—George Wyszomierski

*Attorney, Agent, or Firm*—Robert A. Walsh; James W. McFarland; Jerry J. Holden

[57] ABSTRACT

A turbine rotor is formed from a turbine disk having a rim with a circumferential direction, and a plurality of turbine blade segments each fixed to the turbine disk around a circumference of the rim of the turbine disk. The turbine blade segments are oriented such that the elastic modulus of the turbine blade segments parallel to the circumferential direction is less than that of the rim of the turbine disk parallel to the circumferential direction. This arrangement is preferably achieved using single crystal turbine blade segments made of an an alloy having a cubic crystal structure, such as a nickel-based superalloy, with a <010> direction oriented radially and a <001> direction oriented circumferentially.

6 Claims, 5 Drawing Sheets

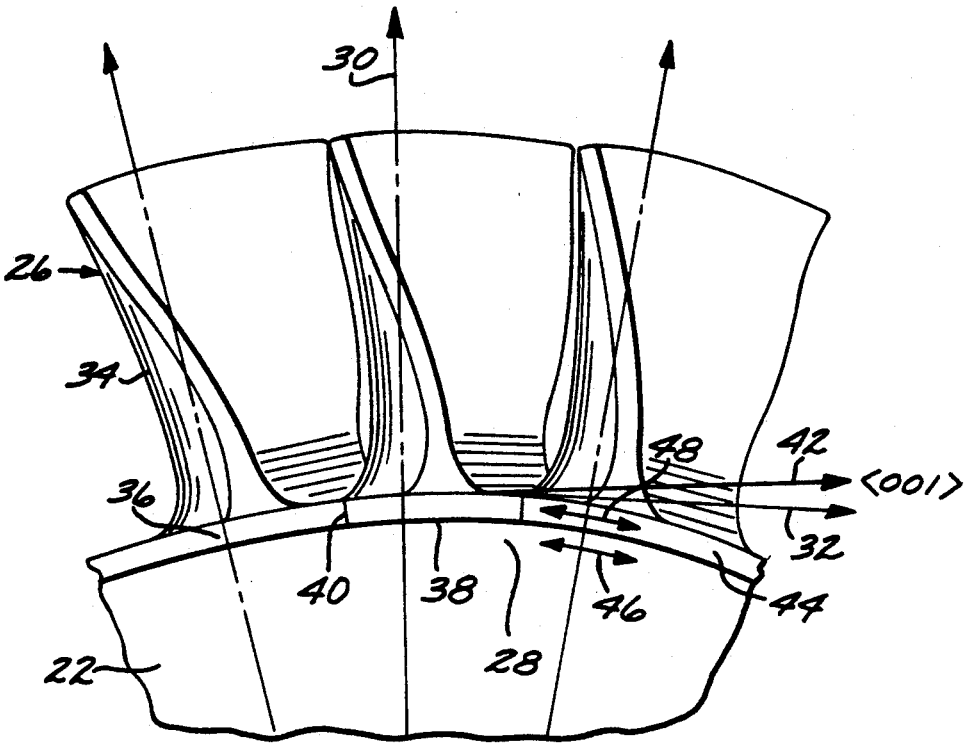
FIG. 3
FIG. 4
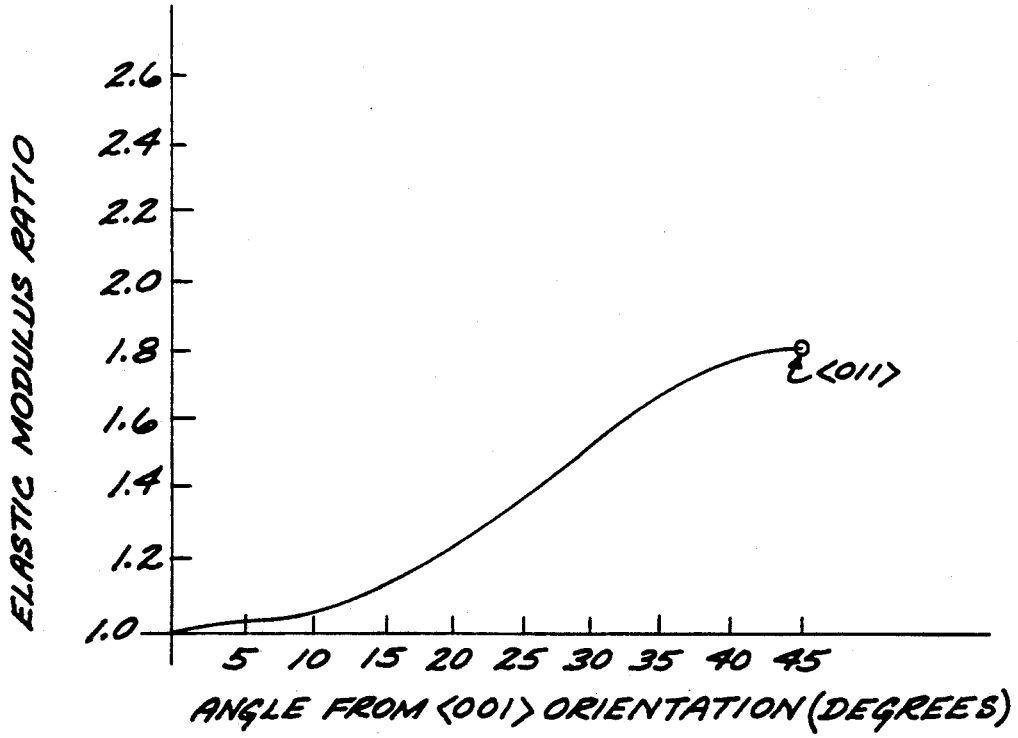

TURBINE ROTOR HAVING IMPROVED RIM DURABILITY

BACKGROUND OF THE INVENTION

This invention relates to aircraft engines, and, more particularly, to the design of a turbine rotor.

A jet engine draws air into the front of the engine, compresses the air with a rotating compressor that is mounted on a rotating shaft, and mixes fuel with the compressed air. The mixture of fuel and air is burned in a combustor, and the hot exhaust gases are passed through a turbine. The turbine is supported on the same shaft as the compressor, so that the turbine provides the power to operate the compressor.

In the axial flow jet engine, the turbine includes a set of stationary turbine vanes that deflect the flow of hot exhaust gases, and a turbine rotor having turbine blades mounted on the rim or periphery of a turbine disk. The center of the turbine disk is supported on the shaft. Hot exhaust gases pass through the vanes and are deflected slightly. The deflected gases impinge upon the turbine blades and force them sideways, causing the turbine disk and thence the shaft to turn. The preceding description of a jet engine is intended to be conceptual in nature, and it will be appreciated that there are typically numerous compressor and turbine stages mounted on the central shaft, and other complex structure.

The turbine blades are typically made of metallic superalloys having superior strength and creep properties at temperatures of 1800–2100 F. The turbine disk may be made of the same material, or a material having superior strength and fatigue resistance properties at lower temperatures, inasmuch as the turbine disk does not experience as high a temperature as do the turbine blades.

Even with the careful selection of material properties for the turbine disk, it is observed that fatigue cracks can form in the rim of the turbine disk at locations between the turbine blades. These cracks can then propagate into the body of the turbine disk, unless stopped, and eventually lead to failure of the turbine disk. One approach to reducing the incidence of fatigue cracks in the rim of the turbine disk is to make short radial slots in the rim of the turbine disk between the turbine blades. A hole is drilled at the bottom of each of the slots to increase the radius of curvature of the slot, thereby reducing the stress concentration at the bottom of the slot to prevent the slot from propagating as a crack. Thus, uncontrolled formation and propagation of fatigue cracks in the rim of the turbine disk is avoided by artificial placement of controlled slots to relax the stresses that are produced in the rim of the turbine disk.

This slotting approach is operable and has been widely used. However, it has the shortcoming that the rim of the turbine disk is weakened and the centrifugal loading of the remainder of the disk hub is increased by the presence of the slots. There is therefore a need for some improved approach to reducing the incidence of fatigue cracks in the rim of the turbine disk.

SUMMARY OF THE INVENTION

The present invention provides a turbine rotor that can replace a conventional turbine rotor, without otherwise changing the design of the engine. The turbine rotor of the invention experiences reduced incidence of fatigue cracking at the rim of the turbine disk, as compared with a conventional rotor. No slots are required in the rim of the turbine disk, although the present approach can be used in conjunction with slotted rim designs if desired.

In accordance with the invention, a turbine rotor comprises a turbine disk having a rim with a circumferential direction and a plurality of turbine blade segments, each fixed to the turbine disk around a circumference of the rim of the turbine disk. The turbine blade segments are oriented such that the elastic modulus of the turbine blade segments parallel to the circumferential direction is less than that of the rim of the turbine disk parallel to the circumferential direction. In one design, each of the blade segments has a platform region that is fixed to the turbine disk around a circumference of the rim of the turbine disk such that the platform regions of the plurality of turbine blade segments collectively form a secondary rim around the circumference of the turbine disk having a lower circumferential elastic modulus than that of the rim of the turbine disk.

Control of the stress and strain states at the rim of the turbine disk is preferably achieved by using single crystal turbine blade segments made from superalloys having a cubic crystallographic crystal structure. In accordance with this aspect of the invention, a turbine rotor comprises a turbine disk having radial and circumferential directions and a plurality of single-crystal turbine blade segments fixed to the turbine disk around a circumference of a rim of the turbine disk. Each turbine blade segment is made of a material having a cubic crystal structure and having a <010> direction oriented parallel to the radial direction of the turbine disk and a <001> direction oriented substantially parallel to the circumferential direction of the turbine disk in the region where the turbine blade segment is fixed to the turbine disk.

The <001> crystallographic direction of cubic materials is a "soft" elastic direction, with the modulus of elasticity less than that in other directions. The <001> crystallographic direction also has the important characteristic that it lies perpendicular to the symmetrically oriented <010> direction, which exhibits a low creep rate. These properties and characteristics are used to advantage by orienting the single-crystal turbine blade segments so that each one has the <010> direction extending radially outwardly from the turbine disk, to achieve low creep rates resulting from the centrifugal forces created during operation of the turbine rotor and also prolonged stress rupture lives at elevated temperatures.

The single-crystal turbine blade segments are further oriented so that the <001> direction is substantially parallel to the circumferential direction of the turbine blade disk, to achieve a low elastic modulus in the circumferential direction. The effect of orienting the plurality of turbine blade segments in this manner is to create a secondary rim of low modulus, or equivalently stated, high compliance, in the circumferential direction of the turbine disk. The secondary rim of low modulus is less susceptible to fatigue cracking than the rim of the turbine disk, made of higher modulus material. In a typical case, the circumferential modulus of the secondary rim may be as much as 40 percent less than the circumferential modulus of the rim of the turbine disk. Since circumferential loading of the rim of the turbine disk is strain controlled, a reduction in elastic modulus by 40 percent reduces the circumferential stress by 40 percent.

The circumferential stress is the principal cause of fatigue failure at the surface of the rim. The result of a reduced circumferential stress is a reduced tendency to form fatigue cracks at the outer surface of the turbine disk, and thence improved performance of the turbine disk and the turbine rotor without the need for slotting of the rim of the turbine disk. An increase in the fatigue life of the turbine disk before rim cracking is observed may be about two orders of magnitude (a factor of 100) as a result. The present approach may also be used in conjunction with slotting of the turbine disk rim.

BRIEF DESCRIPTION OF THE DRAWINGS

FIG. 3 is an enlarged diagrammatic elevational view of the rim region of the turbine rotor of FIG. 2, with the turbine blade segments attached;

FIG. 4 is a graph of elastic modulus ratio as a function of orientation variation from <001>;

DETAILED DESCRIPTION OF THE INVENTION

Figure 1:
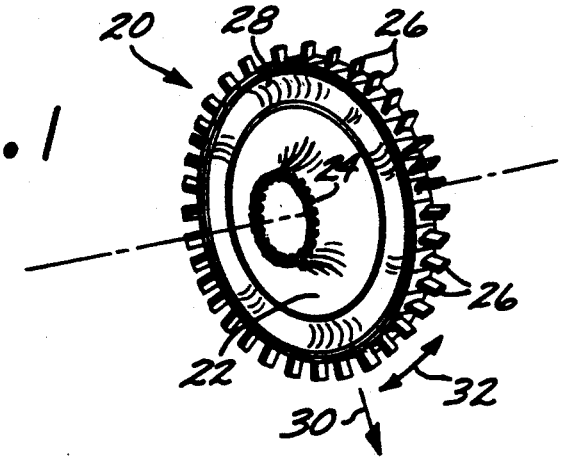
FIG. 1 is a perspective view of an axial flow turbine rotor.

An axial flow turbine rotor 20 is depicted in FIG. 1. The turbine rotor 20 includes a turbine disk 22 that is fixed to a shaft 24 that is free to turn on bearings (not shown). A plurality of turbine blade segments 26 are fixed to a rim 28 of the turbine disk 22, projecting radially outwardly from the rim 28. When the turbine rotor 20 is mounted in a jet engine, hot exhaust gases impinge upon the turbine blade segments 26 at an angle, causing the turbine blade segments 26 to be deflected sideways. The turbine disk 22 and shaft 24 therefore turn on the bearings, providing mechanical power for turning the compressor (not shown) in the front end of the engine. For reference purposes, a radial direction 30 and a circumferential direction 32 are indicated, relative to the rim 28.

Figure 2:
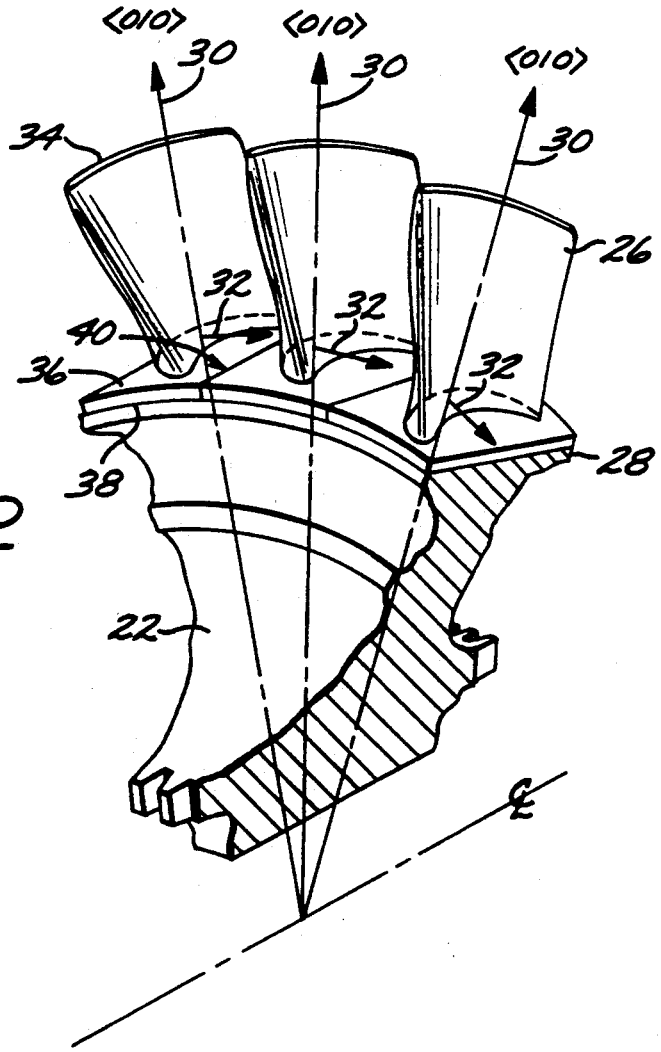
FIG. 2 is an enlarged detail of FIG. 1, illustrating the turbine blade segments bonded to the turbine disk.

FIG. 2 is an enlarged detail of the rim region of FIG. 1, illustrating the structure of the turbine blades and their attachment to the turbine disk. In the preferred form of the invention, each turbine blade segment 26 includes a curved airfoil section 34 (against which the hot exhaust gases impinge during operation) supported on a platform section 36. The platform 36 of each turbine blade segment 26 is bonded to the rim 28 of the turbine disk 22 along a segment/disk bonding surface 38, as by diffusion bonding or brazing, or there may also be a mechanical interconnect. As shown, the platform 36 of each turbine blade segment 26 is dimensioned to contact the circumferentially adjacent turbine blade segment, along a segment/segment circumferential bonding surface 40.

The platform section 36 and the airfoil section 34 are preferably a single integral piece of a single-crystal nickel-based superalloy having a cubic (and in particular a face-centered cubic) crystallographic structure. The single crystal structure is oriented in the manner shown in FIGS. 2 and 3, with a <010> crystallographic direction substantially parallel to the local radial direction 30 of the turbine disk 22. The superalloys have good creep and deformation resistance in the <010> crystallographic direction, and therefore are resistant to creep and deformation resulting primarily from the centrifugal forces imposed upon the blade segments 26 as the turbine rotor 20 turns.

The single crystal structure of the turbine blade segment 26 is further oriented with a <001> crystallographic direction 42 substantially parallel to the local rim circumferential direction 32 of the turbine disk 22. As used herein, "substantially parallel" has a physical meaning, as illustrated in FIG. 3. The relations between the crystallographic directions of the single crystal turbine blade segments 26 and the radial and circumferential directions of the turbine disk 22 may not be absolutely identical, but may be so close as to achieve the benefits of the invention. The relations may not be identical for several reasons. The growth of single crystals is not an exact science, and the grown turbine blade segments may deviate from the desired orientations by a few degrees. Also, because the turbine blade segment 26 is of finite width, regions circumferentially separated from the centerline of the blade segment will necessarily deviate slightly from the desired orientation with respect to the circumferential direction 32. Further, the airfoil sections 34 may be complexly curved, requiring deviations of the crystallographic <010> direction from the radial direction of the turbine disk by a few degrees.

(Those skilled in the art will recognize that the cubic symmetry renders the <001>, <010>, and <100> directions identical both as to structure and properties. The present discussion describes the crystallographic structure in terms of the <010> direction and the <001> direction to avoid confusion. Thus, the <010> and the <001> directions both have good creep/deformation resistance and low elastic modulus, but it is creep/deformation resistance that is important to the orientation of the <010> direction in the present design, and the low elastic modulus that is important to the orientation of the <001> direction in the present design.)

Small deviations from identical parallel relations are tolerated in the present invention while retaining the benefits of the invention, for the reason illustrated in FIG. 4. FIG. 4 is a graph of the ratio of the elastic modulus of a cubic single crystal as a function of misorientation from the <001> direction toward the <011> direction. A key benefit realized by the present invention is that the elastic modulus parallel to the <001> direction is less than that in any other direction. Thus, the elastic modulus ratio of elastic modulus in a selected direction to that in the <001> direction is always greater than 1.0. The low elastic modulus in the <001> direction results in low circumferential stresses in that direction during strain-controlled deformation. As shown in FIG. 4, the elastic modulus ratio for small deviations of less than about 15–20 degrees from the <001> direction is about 1.1–1.2 or less, meaning that such small deviations from the <001> direction achieve nearly the same advantages as does the pure <001> direction. Thus, deviations of up to about 20 degrees of the <001> direction from the circumferential direction 32 are permitted within the scope of the invention.

Figure 5:
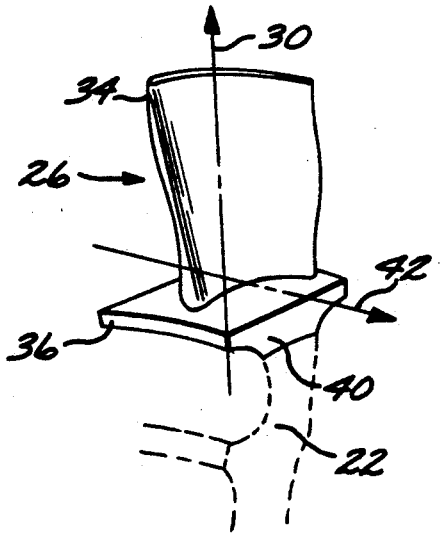
FIG. 5 is a perspective view of a turbine blade segment having a curved circumferential contact surface.

The effect of orienting the <001> direction 42 of the turbine blade segment 26 substantially parallel to the circumferential direction 32 may also be described in terms of the formation of a second rim 44, as illustrated in FIG. 3. The platform section 36 of each turbine blade segment 26 contacts its circumferentially adjacent neighbor along the circumferential bonding surface 40. The circumferential bonding surface 40 can be planar, as illustrated in FIG. 2, or curved as in FIG. 5.

The platform sections 36 therefore collectively form the second rim 44 that extends around the circumference of the turbine disk 22, and is bonded to the rim 28 of the turbine disk 22. The turbine disk 22 is typically formed of a polycrystalline nickel-based superalloy, whose elastic modulus in the rim region 28, indicated diagrammatically as the arrow 46, is typically about 40 percent greater due to the averaging effect of the polycrystalline structure than the modulus of the second rim 44, indicated diagrammatically as the arrow 48. The turbine disk 22 may be made of the same material as the turbine blade segment 26 or of a different material, and therefore the figure of 40 percent is an approximation. The circumferential modulus 48 of the second rim 44 is that of the <001> direction of the turbine blade segment 26, as previously explained. The second rim 44 becomes the effective outer rim of the turbine disk 22, so that the largest strain-controlled loadings are applied to the second rim 44. Because of its lower circumferential modulus of elasticity, there is a reduced tendency to initiation and propagation of radial fatigue cracks into the second rim 44 than into the rim 28 of higher modulus material.

Figure 6:
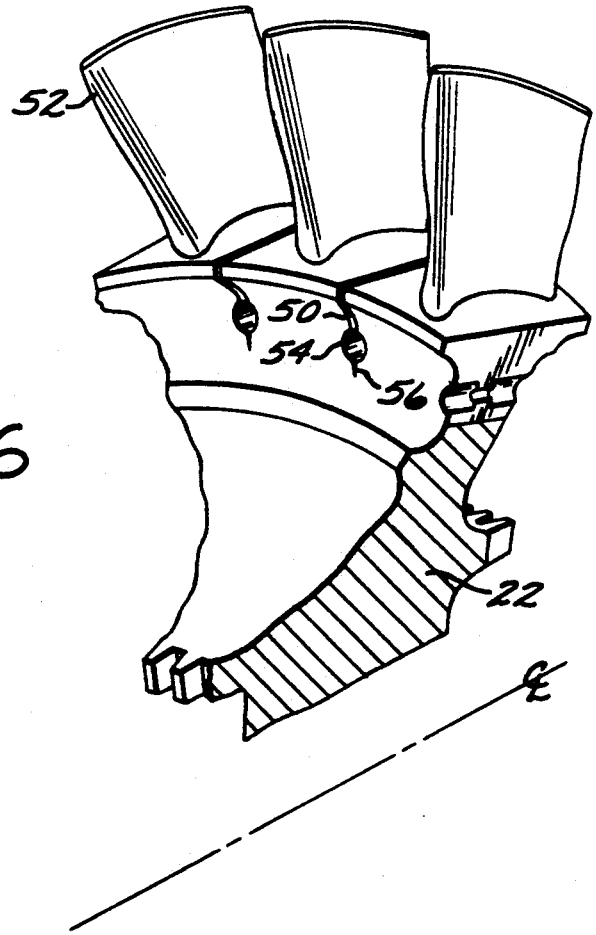
FIG. 6 is a view similar to that of FIG. 2, illustrating the location of rim slots and fatigue cracks in conventional turbine rotors.

The present approach is to be contrasted with the approach of the prior art to reducing the incidence of radial fatigue cracks, illustrated in FIG. 6. In this prior approach, there is no attempt to orient the <001> direction parallel to the circumferential direction 32. Instead, a slot 50 is cut radially into the rim 28 of the turbine disk 22 between each pair of turbine blades 52. The slots relieve the circumferential stress in the rim region of the turbine disk. Because each slot 50 could itself act as a crack initiation site, a bore 54 is drilled at the end of each slot 50 to relieve the stress. However, it is still observed that fatigue cracks 56 may initiate from the bores 54 during service. The present approach avoids this problem.

Figure 7:
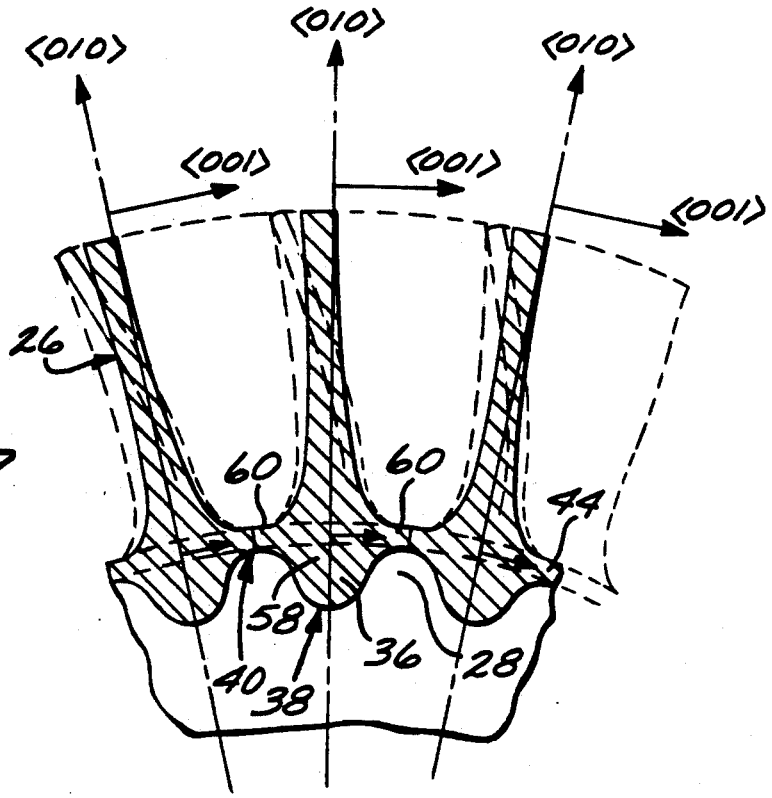
FIG. 7 is a view similar to that of FIG. 3, using a nonplanar bonding surface between the turbine blade segments and the turbine disk.

The turbine rotor 20 may be further improved by extending the platform section 36 of the turbine blade segment 26 radially inwardly further into the turbine disk 22, as shown in FIG. 7. The effect of this modification is to make the radial bonding surface 38 nonplanar. In the illustrated preferred approach, a central portion 58 of the platform section 36 extends radially inwardly further than do edge portions 60 of the platform section 36 adjacent to the circumferential bonding surfaces 40. The radial bonding surface 38 is preferably tapered between these extremes for each of the turbine blade segments 26, with the result being a generally sinusoidally varying, radially tapered, bonding surface 38, when viewed in the elevational view of FIG. 7.

The tapered bonding surface approach of FIG. 7 has several advantages. First, there is a greater bonding area for the turbine blade segment 26 to bond to the turbine disk 22. The stress level at the bond surface (i.e., force per unit area of bond surface) is reduced, reducing the tendency to initiate and propagate fatigue cracks and to creep. Second, the stress state at the bonding surface 38 is changed from a tensile stress state to a mixed tensile and shear stress state. The reduced creep resistance of the turbine disk observed in some designs can be improved by the use of a tensile-plus-shear bond rather than a tensile-only bond. Third, the radial gradient of the effective circumferential elastic modulus between the rim 28 of polycrystalline material of the turbine disk 22 and that of the second rim 44 formed by the continuous platform sections 36 is also reduced. That is, there is a smooth transition between the rim 28 and the second rim 44, reducing the incidence of complex stress states that may lead to life limiting failure modes.

Figure 8:
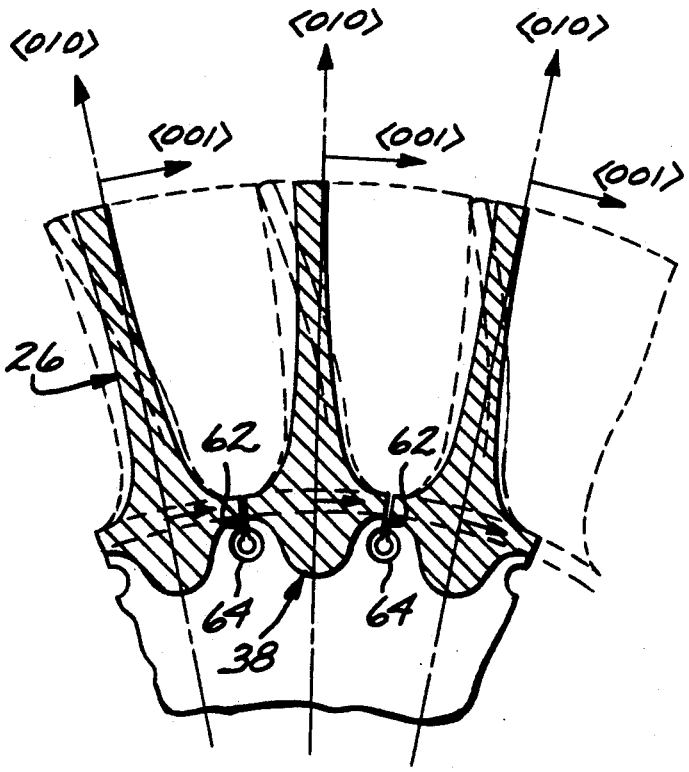
FIG. 8 is an elevational view similar to that of FIG. 3, with a rim slot present.

FIG. 7 illustrates the use of the present invention generally, and the nonplanar radial bonding surface specifically, in a turbine rotor having no radial slots. As illustrated in FIG. 8, the present approach can also be used where slots 62 have been cut radially to relieve stress concentrations at a countersink bore or rivet hole 64. The net stress and strain at such bores or holes 64 is thereby reduced, as well as the general level of circumferential stress in the rim region of the turbine disk.

Figure 9:
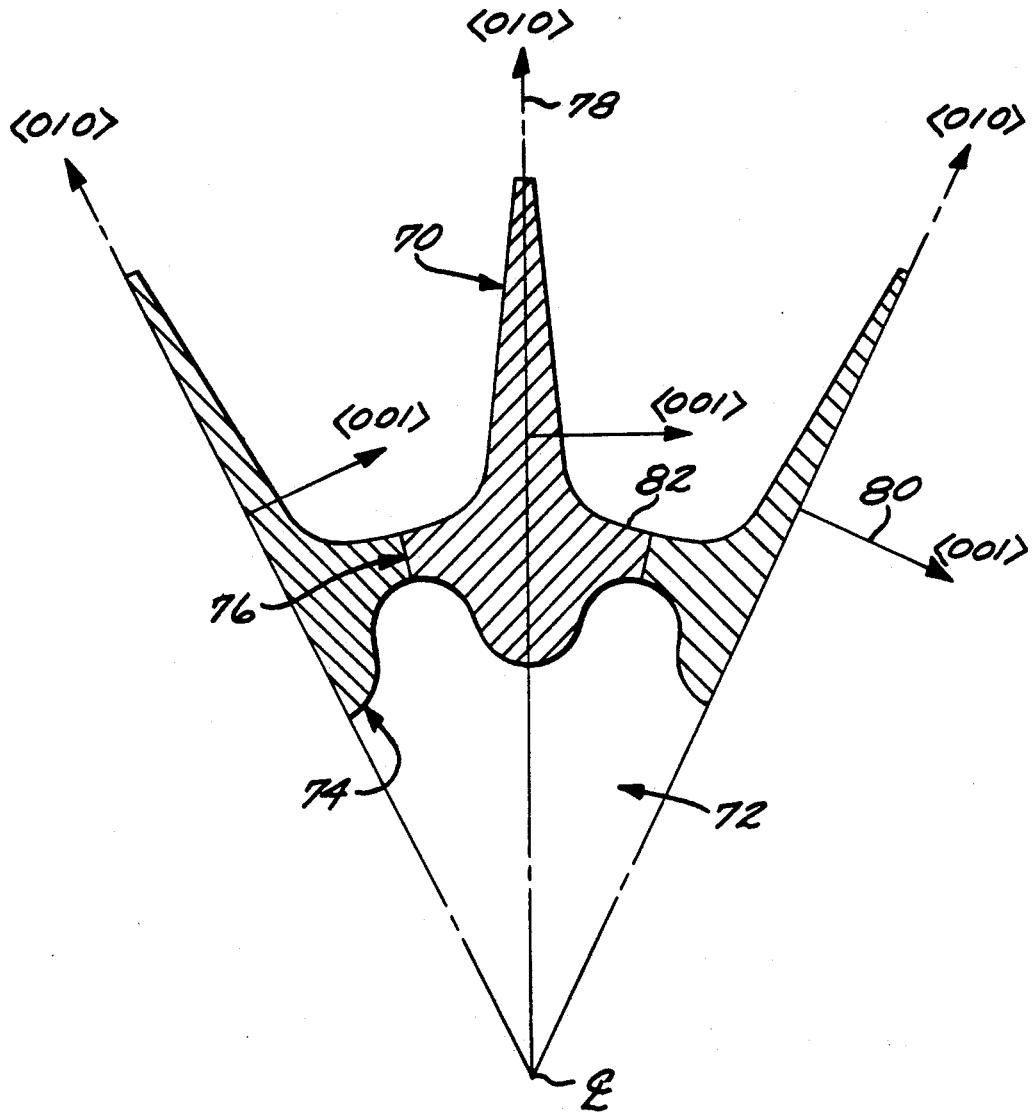
FIG. 9 is an elevational view of a portion of a radial flow turbine rotor that uses the approach of the invention.

To now, the approach of the invention has been discussed in relation to the axial flow turbine rotor 20 of FIG. 1. The present approach can also be used to reduce circumferential stresses and saddle stresses in radial flow or mixed flow turbine rotors. A portion of a radial flow turbine rotor is illustrated in FIG. 9. Here, radial flow turbine blade segments 70 are bonded to a radial flow turbine disk 72 along a radial bonding surface 74, and to each other at circumferential bonding surfaces 76. The bonding surfaces 74 and 76 can be planar or curved, as was previously discussed in relation to the axial flow turbine rotor. The radial flow turbine blade segments are also preferably single crystals of nickel-based superalloys having a <010> crystallographic direction 78 oriented substantially radially with respect to the turbine disk 72, and a <001> crystallographic direction 80 oriented substantially circumferentially with respect to the turbine disk 72, for the same reasons discussed previously.

In radial flow turbine rotors of the type illustrated in FIG. 9, an ongoing problem is fatigue cracking in the region between blade segments, known as the saddle region 82. The saddle region 82 corresponds generally with the region between the turbine blade segments 70 where the circumferential bond surfaces 76 are located. The saddle stresses are reduced for the same reasons discussed previously.

The present inventions deal generally with crystallographic orientations and geometry of turbine blades relative to turbine disks, and may be used in conjunction with any applicable design, material combination, and manufacturing technique, within the constraints discussed herein. In one example, presented for illustration but not by way of limitation, the turbine disk 22 (also sometimes called the hub) is made from Astroloy or Udimet 720 deposited by vacuum plasma structural deposition and consolidated by hot isostatic pressing. The turbine blade segment is made from a single-crystal nickel based superalloy such as SC180 and grown by reducing the temperature at one end of a mold containing the material. The turbine blade segment is joined to the turbine disk with the correct orientations as set forth herein by any acceptable approach, such as diffusion bonding, activated diffusion bonding, or brazing.

While the invention has been described herein with reference to certain specific embodiments, it is to be understood that the scope of the invention should not be limited to such embodiments, but rather should be afforded the full scope of the appended claims.

What is claimed is:

1. A turbine rotor, comprising:

a turbine disk having radial and circumferential directions; and a plurality of single-crystal turbine blade segments fixed to the turbine disk around a circumference of a rim of the turbine disk, each turbine blade segment being made of a material having a cubic crystal structure and having a <010> direction oriented parallel to the radial direction of the turbine disk and a <001> direction oriented substantially parallel to the circumferential direction of the turbine disk in the region where the turbine blade segment is fixed to the turbine disk.

2. The turbine rotor of claim 1, wherein the turbine disk is made of a nickel-based superalloy.

3. The turbine rotor of claim 1, wherein the plurality of turbine blade segments are made of a nickel-based superalloy.

4. The turbine rotor of claim 1, wherein each of the turbine blade segments is joined to the turbine disk along a nonplanar bond surface.

5. The turbine rotor of claim 4, wherein the bond surface of each turbine blade segment is furthest from the center of the turbine disk at locations radially aligned with the circumferential edges of the turbine blade segments, and is closest to the center of the turbine disk at a location radially aligned with the center of the turbine blade segment.

6. The turbine rotor of claim 1, wherein turbine blades are structured as axial flow turbine blades.

* * * * *